US005243683A

United States Patent [19]

Yang

[11] Patent Number: 5,243,683

[45] Date of Patent: Sep. 7, 1993

[54] LAMINAR STREAMFLOW-GUIDED HAIR DRYER WITH FINNED PTC HEATING MEANS

[76] Inventor: Chiung-hsiang Yang, c/o Hung Hsing Patent Service Center, P.O. Box 55-1670, Taipei (10477), Taiwan

[21] Appl. No.: 911,065

[22] Filed: Jul. 9, 1992

[51] Int. Cl.[5] ..... H05B 1/02; H05B 3/10; F24H 3/02; A45D 20/10

[52] U.S. Cl. ..... 392/379; 165/183; 219/505; 219/530; 219/540; 219/544; 338/22 R; 338/51; 392/360; 392/365; 392/385; 392/485

[58] Field of Search ..... 392/365-369, 392/379-385, 347, 360, 485; 219/504, 505, 530, 540, 544; 165/183; 338/51, 22 R

[56] References Cited

U.S. PATENT DOCUMENTS

| | | | |
|---|---|---|---|
| 1,730,982 | 10/1929 | Pankratz et al. | 392/383 X |
| 1,771,752 | 7/1930 | Fischer | 219/540 X |
| 1,928,270 | 9/1933 | Shirley | 392/365 |
| 2,085,772 | 7/1937 | Soverhill | 338/51 X |
| 2,405,722 | 8/1946 | Villier | 392/379 X |
| 3,263,749 | 8/1966 | Dormiter | 392/360 X |
| 4,939,349 | 7/1990 | Liu | 219/504 X |
| 4,942,289 | 7/1990 | Roller et al. | 219/544 X |
| 4,990,748 | 2/1991 | Starck | 219/504 X |

FOREIGN PATENT DOCUMENTS

| | | | |
|---|---|---|---|
| 2402902 | 7/1974 | Fed. Rep. of Germany | 392/360 |
| 2626409 | 12/1977 | Fed. Rep. of Germany | 392/379 |
| 2292396 | 6/1976 | France | 219/540 |
| 2381976 | 9/1978 | France | 219/540 |
| 58-86346 | 5/1983 | Japan | 392/379 |
| 64-77889 | 3/1989 | Japan | 219/540 |
| 23314 | of 1915 | United Kingdom | 219/540 |
| 1034594 | 6/1966 | United Kingdom | 219/530 |
| 2076270 | 11/1981 | United Kingdom | 392/360 |

*Primary Examiner*—Anthony Bartis

[57] ABSTRACT

A hair dryer includes a plurality of elongated positive-temperature-coefficient (PTC) semiconductor heating units disposed in transverse side-by-side spaced relation in a linear array in a central air flow passage of an elongated tubular duct connected to a discharge port of a casing having an air fan rotatably mounted in the casing for blowing air through the air flow passage of the duct, each PTC heating unit defining a longitudinal axis disposed perpendicular to a longitudinal axis of the air flow passage of the duct and a plurality of elongated spaced fins longitudinally juxtapositionally mounted on the PTC semiconductor heating unit transversely of the longitudinal axis of the PTC heating unit, whereby upon a powering of the PTC heating unit and the fan to heat air as blown by the fan, the heated air will be guided in the tubular duct by the plurality of elongaed spaced fins to produce laminar air streamflow helpful for smoothly setting and drying hair or the like.

6 Claims, 4 Drawing Sheets

LAMINAR STREAMFLOW-GUIDED HAIR DRYER WITH FINNED PTC HEATING MEANS

BACKGROUND OF THE INVENTION

A conventional dryer such as a hair dryer is provided with helical resistance conductors or chrome-alloyed electric heating wires or coils for heating air blown by a fan in the dryer. However, such a heating wire may be easily broken due to abnormal overheating to influence its heating function. Meanwhile, the air blown through the heating coils in the dryer housing is not well guided to possibly cause turbulent flow which may influence a hair drying and setting operation.

It is therefore expected to disclose a dryer provided with positive-temperature-coefficient (PTC) semiconductor heating elements for a safer heating operation and also for effectively guiding heated air streams through the dryer helpful for a hair drying and setting operation.

SUMMARY OF THE INVENTION

The object of the present invention is to provide a hair dryer including a positive-temperature-coefficient (PTC) semiconductor heating unit longitudinally mounted in a tubular duct connected to a discharge port of a casing having an air fan rotatably mounted in the casing, and a plurality of fins longitudinally juxtapositionally mounted on the PTC semiconductor heating unit, whereby upon a powering of the PTC heating unit and the fan to heat air as blown by the fan, the heated air will be guided by the plurality of fins to produce laminar air streamflow helpful for smoothly setting and drying hair.

DETAILED DESCRIPTION

Figure 1:
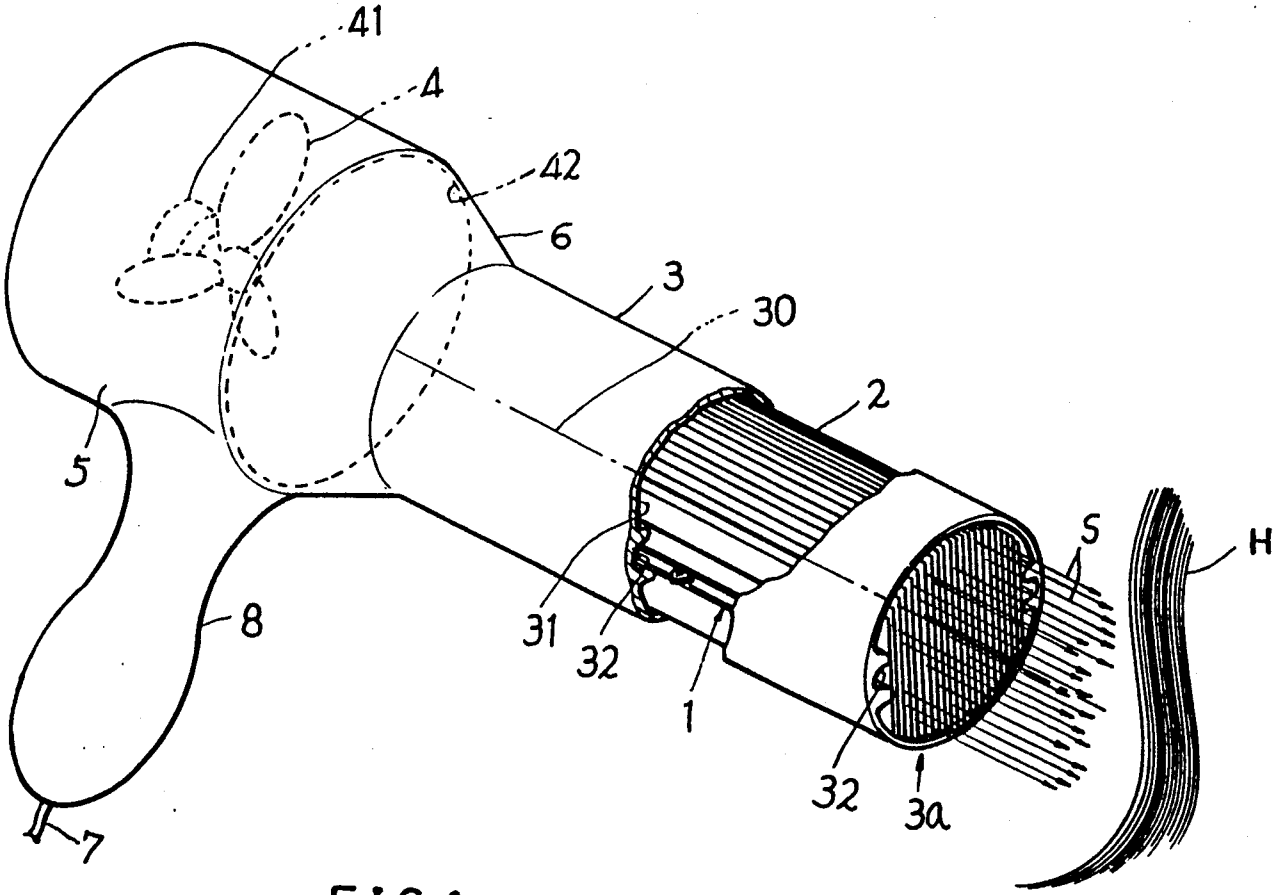
FIG. 1 is a perspective view of the present invention.

As shown in FIGS. 1–4, the present invention comprises: a plurality of elongated positive-temperature-coefficient (PTC) semiconductor heating means 1 each heating means 1 generally formed as an elongate body, a plurality of elongated spaced fins 2 mounted on the heating means 1, an elongated tubular duct 3 encasing the heating means 1 and the fins 2 in the duct 3, a fan 4 driven by a motor 41 mounted in a casing 5 having a funnel portion 6 formed on a discharge port of the fan 2 for connecting the casing 5 and the duct 3, and a power source 7 for powering the motor 41 and the heating means 1. Besides the fan 4, other sources for supplying air may be used in this invention.

Figure 1A:
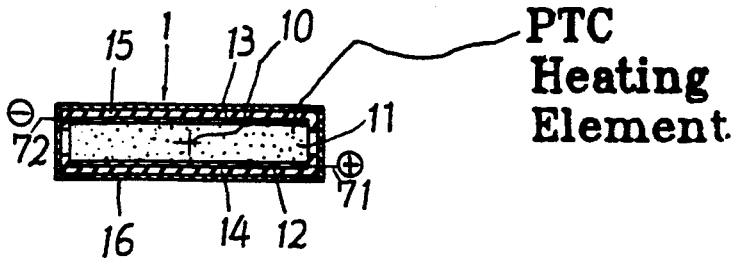
FIG. 1*a* is a sectional drawing of a PTC heating means of the present invention.

Each positive-temperature-coefficient (PTC) semiconductor heating means 1 as shown in FIG. 1*a* may be used in this invention which includes: a positive-temperature-coefficient (PTC) semiconductor heating element 11 having two opposite electrically conducting surfaces embedded in between two electrical contact plates 12, 13 respectively electrically connected to two poles 71, 72 of the power source 7, a pair of electrically insulating plates 14, 15 respectively disposed around the two contact plates 12, 13, and a thermally conductive casing 16 encasing the insulating plates 14, 15, the contact plates 12, 13 and the heating element 11 within the casing 16.

Other choices of the structure, arrangement, or design of the PTC heating means 1 may be made by those skilled in the art and not limited in this invention.

Moreover, the shapes and configurations of the duct and casing, the kinds of air fan, and the number of the heating means 1 and fins 2 of this invention are not limited. Other modifications may be suitably made in accordance with the present invention. For instance, a handle 8 can be secured with the casing 5 for portable purpose. The funnel portion 6 can be omitted when an incoming air is directed from a compressed air source or a force-drafted circulation air system. The duct 3 may be formed as any pipes with any cross sectional shapes, but preferably made of cylindrical shape.

Figure 2:
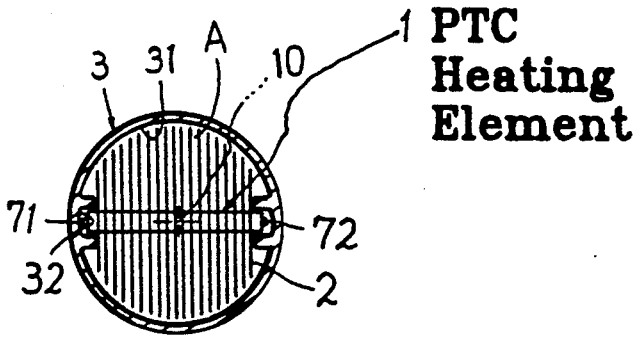
FIG. 2 is a cross sectional drawing of the present invention.

The fins 2 may be made of aluminum or aluminum alloy, which are preferably made to fully occupy the space in the duct 3 as shown in FIG. 2 to increase heat-exchange efficiency with the air blown by the fan 4.

Figure 3:
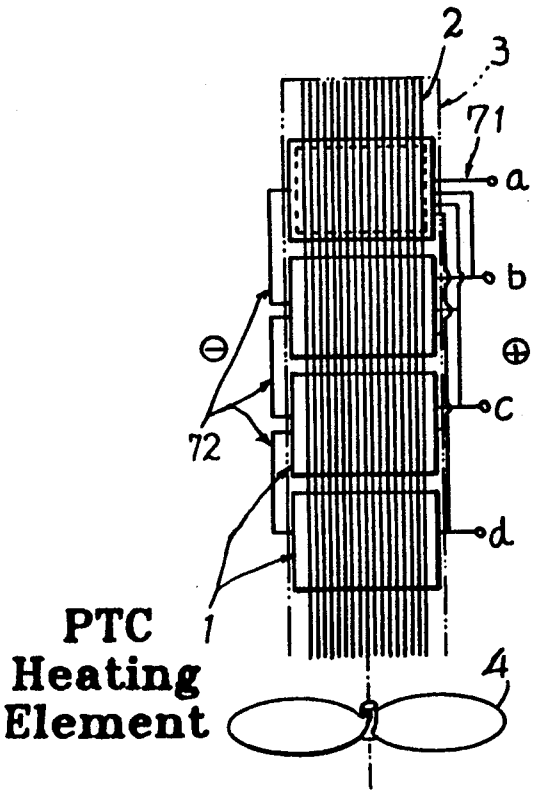
FIG. 3 is a top view illustration of the present invention.
Figure 4:
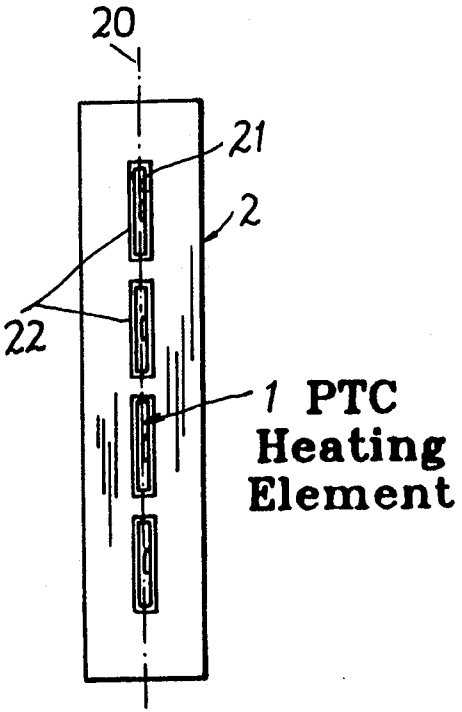
FIG. 4 is a side view of a fin of the present invention.
Figure 4A:
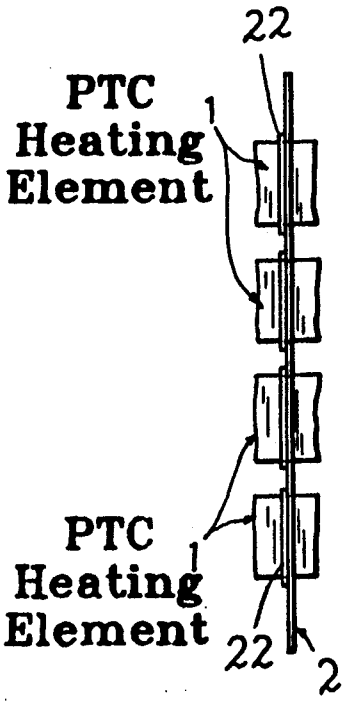
FIG. 4A is an illustration showing the fins provided with the flanges from a side view of FIG. 4.

Each fin 2 as shown in FIGS. 2, 3, 4 includes: a longitudinal plate generally rectangular shaped having a longitudinal central line 20 formed in a central portion of the longitudinal plate, and a plurality of elongated slots 21 longitudinally formed and equally spaced in the longitudinal plate for embedding each positive-temperature-coefficient semiconductor heating means 1 in each slot 21.

Each slot 21 is surrounded with a peripheral extension 22 circumferentially formed along a contour of the slot 21 for frictionally holding each positive-temperature-coefficient semiconductor heating means 1 in each slot 21.

The plurality of fins 2 are longitudinally juxtapositionally mounted and equally spaced on the PTC heating means 1 with every two neighbouring fins 2 defining an air-flowing path A between the two fins 2.

As shown in FIG. 3, a plurality of positive-temperature-coefficient semiconductor heating means 1 are longitudinally disposed in the tubular duct 3, and the plurality of positive-temperature-coefficient semiconductor heating elements 11 of the heating means 1 are electrically connected in parallel with the two poles 71, 72 of the power source 7. A plurality of electrical contactors may be provided for selectively closing the relevant contactors (not shown) by adding (or deducting) the output power (watts) of the PTC heating elements 11 as parallelly connected. For instance, a first PTC heating means at numeral "a" may obtain an output power of 150 watts (W) about 60 C., at "b" of 300 W about 120 C., at "c" of 450 W about 160 C., and at "d" of 600 W about 200 C. If the fan motor speed is adjustable such as for "high" or "low" adjustment, the output power or temperature caused by the dryer of this invention will be more variable.

Figure 5:
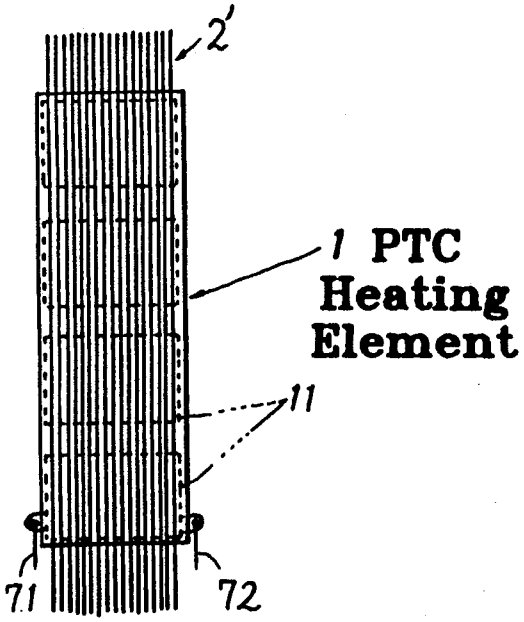
FIG. 5 is a top view illustration of another preferred embodiment of the present invention.
Figure 6:
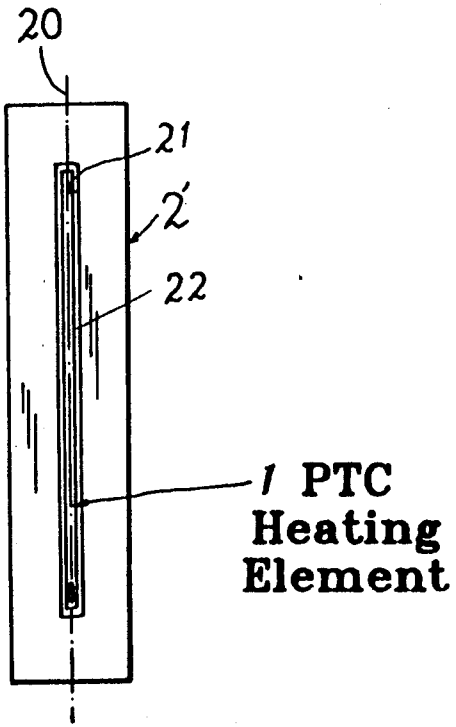
FIG. 6 is a side view of another fin of the present invention.
Figure 6A:
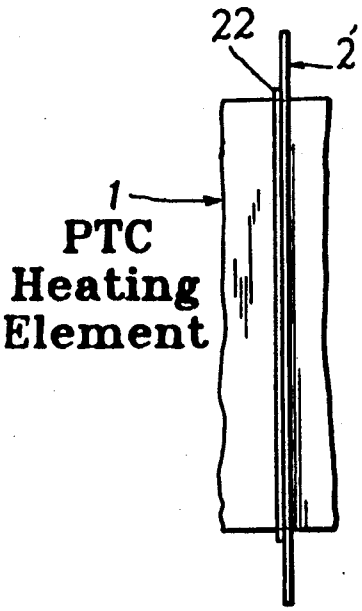
FIG. 6A is an illustration showing the fin provided with the flange from a side view of FIG. 6.

As shown in FIGS. 5, 6, the PTC semiconductor heating means 1 may be modified from the aforementioned embodiment to be a single parallelepiped by longitudinally embedding a plurality of PTC semiconductor heating elements 11 within the casing 16 and each fin 2 is formed with a longitudinal slot 21 formed along a longitudinal central line 20 of a longitudinal plate of the fin 2 for engaging the slot 21 of each fin 2 with the heating means 1 for juxtapositionally mounting a plurality of the fins 2 on the heating means 1.

The PTC heating means 1 may be secured in two fastening brackets 32 disposed in two opposite sides in a central hole 31 longitudinally formed through the tubular duct 3 defining a longitudinal duct axis 30. The PTC heating means 1 defines a longitudinal axis 10 aligned with the longitudinal duct axis 30 of the tubular duct 3.

When a switch is switched on for driving the fan motor and the fan for blowing air from the casing 5 through the funnel portion 6 towards the duct 3 and for heating the PTC heating means 1, the heat will be radiated outwardly through the fins 2 to heat the air. Since the air is guided through the plural parallel fins 2, the airflow steam discharged from the duct opening 3*a* will become a laminar flow S without causing a turbulent or eddy flow, thereby beneficial for smoothly setting and drying a person's hair H and for enhancing a better heat exchange operation during the longer passages of the fins 2 to therefore be superior to a conventional hair dryer.

Naturally, if the air blowing speed is increased too much, a turbulent flow may still be caused so that an adjusting knob (not shown) may be provided in this invention for controlling the air blowing speed or rate.

Besides, the present invention may be used for drying other human body portions such as hands or other objects.

I claim:

1. A hair dryer comprising:

a plurality of elongated positive-temperature-coefficient (PTC) semiconductor heating means disposed in transverse side-by-side spaced relation in a linear array in a central air flow passage of an elongated tubular duct, each said PTC semiconductor heating means including a PTC semiconductor heating element having two electric conducting surfaces disposed on two opposite side surfaces of said heating element electrically connected to two poles of a power source, at least an electrically insulating plate disposed around one said conducting surface of said heating element, and a thermally conductive casing encasing said heating element and said at least one insulating plate in said casing;

each said heating means generally forming an elongate body defining a longitudinal axis disposed perpendicular to a longitudinal axis of said air flow passage;

a plurality of elongated spaced fins longitudinally juxtapositionally mounted on said PTC semiconductor heating means transversely of the longitudinal axis thereof and disposed in said central passage of said tubular duct parallel to the longitudinal axis of the axis of the passage; and an air fan driven by a fan motor mounted in a casing having a discharge port of said casing connected with said tubular duct for operatively blowing air from said fan towards said duct through said plurality of fins, whereby upon a powering and heating of said heating means, the air as blown through said fins by said fan will be heated by the fins mounted on said heating means, thereby discharging heated air with laminar streamflow for smoothly setting and drying hair.

2. A hair dryer according to claim 1, wherein a funnel portion is connected between a discharge port of the fan of the casing and the tubular duct.

3. A hair dryer according to claim 1, wherein each said PTC semiconductor heating means is secured in two fastening brackets disposed in two opposite sides of said air flow passage longitudinally formed through the tubular duct.

4. A hair dryer according to claim 1, wherein each said fin includes: an elongated generally rectangular plate having a longitudinal central axis formed in a central portion of the longitudinal plate, and a plurality of elongated slots longitudinally formed and equally spaced in the longitudinal plate for embedding a respective one of said positive-temperature-coefficient semiconductor heating means in each said slot.

5. A hair dryer according to claim 4, wherein each said slot is surrounded with a peripheral extension circumferentially formed along a contour of the slot for frictionally holding the positive-temperature-coefficient semiconductor heating means in each said slot.

6. A hair dryer according to claim 1, wherein said plurality of fins are longitudinally juxtapositionally mounted and equally spaced transversely the PTC semiconductor heating means with every two said neighbouring fins defining an air-flowing path between said two neighbouring fins.

* * * * *